US010420178B2

(12) United States Patent
Milanesi et al.

(10) Patent No.: US 10,420,178 B2
(45) Date of Patent: Sep. 17, 2019

(54) LIGHT EMITTING DIODE DRIVER FOR LOAD AND SUPPLY CHANGES

(71) Applicant: Infineon Technologies AG, Neubiberg (DE)

(72) Inventors: Paolo Milanesi, Padua (IL); Fabio Fragiacomo, Montegrotto Terme (IT); Maurizio Galvano, Padua (IT); Roberto Penzo, Vigonza (IT); Enrico Tonazzo, Villanova di Camposampiero (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/458,450

(22) Filed: Mar. 14, 2017

(65) Prior Publication Data

US 2018/0270923 A1 Sep. 20, 2018

(51) Int. Cl.
*H05B 33/08* (2006.01)

(52) U.S. Cl.
CPC ..... *H05B 33/0815* (2013.01)

(58) Field of Classification Search
CPC combination set(s) only.
See application file for complete search history.

(56) References Cited

U.S. PATENT DOCUMENTS 7,728,798 B2 6/2010 Kim
9,203,311 B2 12/2015 Penzo et al.
2015/0256071 A1* 9/2015 Penzo ..... H02M 3/1582 315/297
2015/0264754 A1 9/2015 Ito et al.
2016/0297351 A1 10/2016 Ichikawa

FOREIGN PATENT DOCUMENTS

| | | | |
|---|---|---|---|
| CN | 1825401 | A | 8/2006 |
| CN | 102170727 | A | 8/2011 |
| CN | 104901531 | A | 9/2015 |
| DE | 102015204526 | A1 | 9/2015 |
| DE | 102016205796 | A1 | 10/2016 |

OTHER PUBLICATIONS

U.S. Appl. No. 15/183,551, by Paolo Milanesi, filed Jun. 15, 2016.
U.S. Appl. No. 15/219,150, by Fabio Fragiacomo, filed Jul. 25, 2016.
Office Action, in the German language, from counterpart German Application No. 102018105742.3, dated Nov. 9, 2018, 10 pp.
Office Action, in the Chinese language, from counterpart Chinese Application No. 201810209264.6, dated Jul. 12, 2019, 6 pp.

* cited by examiner

*Primary Examiner* — Douglas W Owens
*Assistant Examiner* — Jianzi Chen
(74) *Attorney, Agent, or Firm* — Shumaker & Sieffert, P.A.

(57) ABSTRACT

In one example, a system includes a load module, a power module, a series module, and a control module. The power module is configured to generate a supply power. The load module is configured to select a subset of light emitting diodes (LEDs) from a set of LEDs. The series module is configured to receive the supply power from the power module, dissipate a portion of the supply power, and output, to the subset of LEDs, a remaining portion of the supply power as a load power. The control module is configured to drive the series module to limit an amount of power at the subset of LEDs.

21 Claims, 8 Drawing Sheets

LIGHT EMITTING DIODE DRIVER FOR LOAD AND SUPPLY CHANGES

TECHNICAL FIELD

This disclosure relates a driver, such as a light emitting diode driver, that is configured to control a voltage, current, or power supplied to a load, such as a string of light emitting diodes.

BACKGROUND

Drivers may control a voltage, current, or power at a load. For instance, a light emitting diode (LED) driver may control a power supplied to a string of light emitting diodes. Some drivers may include a DC to DC converter, such as a buck-boost, buck, boost, or another DC to DC converter. Such DC to DC converters may be required to change the power at the load based on a characteristic of the load. For instance, when operating front lighting of an automobile in a high beam setting, the string of light emitting diodes may require a higher power than when operating in a low beam setting.

SUMMARY

In general, this disclosure is directed to techniques for reducing a current overshoot and undershoot in a load when changing a quantity of load units. For example, in an exemplary automotive application, a light emitting diode (LED) driver may reduce a quantity of active LEDs in a string of LEDs from a first quantity for a first beam setting (e.g., high beam) to a second quantity for a second beam setting (e.g., low beam). In this example, the LED driver may control a series module to limit the power output to the string of LEDs after reducing the quantity of active LEDs to prevent a current overshoot at the string of LEDs.

In an example, a system includes a load module, a power module, a series module, and a control module. The power module is configured to generate a supply power. The load module is configured to select a subset of LEDs from a set of LEDs. The series module is configured to receive the supply power from the power module, dissipate a portion of the supply power, and output, to the subset of LEDs, a remaining portion of the supply power as a load power. The control module is configured to drive the series module to limit an amount of power at the subset of LEDs.

In another example, a method includes generating, by a power module of a circuit, a supply power and selecting, by a load module of the circuit, a subset of LEDs from a set of LEDs. The method further includes receiving, by a series module of the circuit, the supply power from the power module, dissipating, by the series module, a portion of the supply power, and outputting, by the series module, to the subset of LEDs, a remaining portion of the supply power as a load power. The method further includes driving, by a control module of the circuit, the series module to limit the amount of power at the subset of LEDs.

In another example, a system includes a switch logic module, a set of LEDs, a load module, a power module, a series module, and a control module. The switch logic module is configured to generate a switching signal. The load module is configured to selectively bypass, based on the switching signal, each LED of the set of LEDs to form a subset of LEDs. The power module is configured to output a supply power. The series module is configured to receive the supply power from the power, dissipate a portion of the supply power, and output, to the subset of LEDs, a remaining portion of the supply power as a load power. The control module configured to drive the series module to limit an amount of power at the subset of LEDs.

Details of these and other examples are set forth in the accompanying drawings and the description below. Other features, objects, and advantages will be apparent from the description and drawings, and from the claims.

DETAILED DESCRIPTION

Some systems may use a DC to DC converter to control an amount of power supplied to a load, such as a series string of light emitting diodes (LEDs). A power output by the DC to DC converter may be controlled based on a selected number of LEDs that are activated. For example, as the selected number of LEDs increases, a power output by the DC to DC converter is increased and as the selected number of LEDs decreases, the DC to DC converter decreases a power output to the selected LEDs. However, when the selected number of LEDs decreases, the DC to DC converter may supply a power at the series string of LEDs that causes a current at the series string of LEDs to overshoot a desired current, which may cause a failure in one or more of the LEDs in the string of LEDs.

Some systems may use a microcontroller or microprocessor configured to prevent the DC to DC converter from supplying a power that causes the current at the series string of LEDs to overshoot the desired current. For example, a microcontroller or microprocessor may refrain from reducing a selected number of LEDs in a string of LEDs until a power output by the DC to DC converter is stable. However, in some applications, using a microcontroller or microprocessor may add complexity to a resulting device. Further, such systems may rely on complicated software executing at the microcontroller or microprocessor that may add complexity to a resulting device. Additionally, such systems may rely on interconnections between a board housing the microcontroller or microprocessor, a board housing the DC to DC converter, a board housing the LEDs, and other boards.

Rather than relying on a microcontroller or microprocessor to limit a power at LEDs, some systems may include a series module to limit the power output to the LEDs. For example, a series module may be configured to limit the power output to the LEDs after the selected number of LEDs decreases to prevent a current at the LEDs from overshooting the desired current overshoot. In this manner, the series module may prevent the DC to DC converter from supplying a power at the series string of LEDs that causes a current at the series string of LEDs to overshoot the desired current without relying on a microcontroller or microprocessor.

Figure 1:
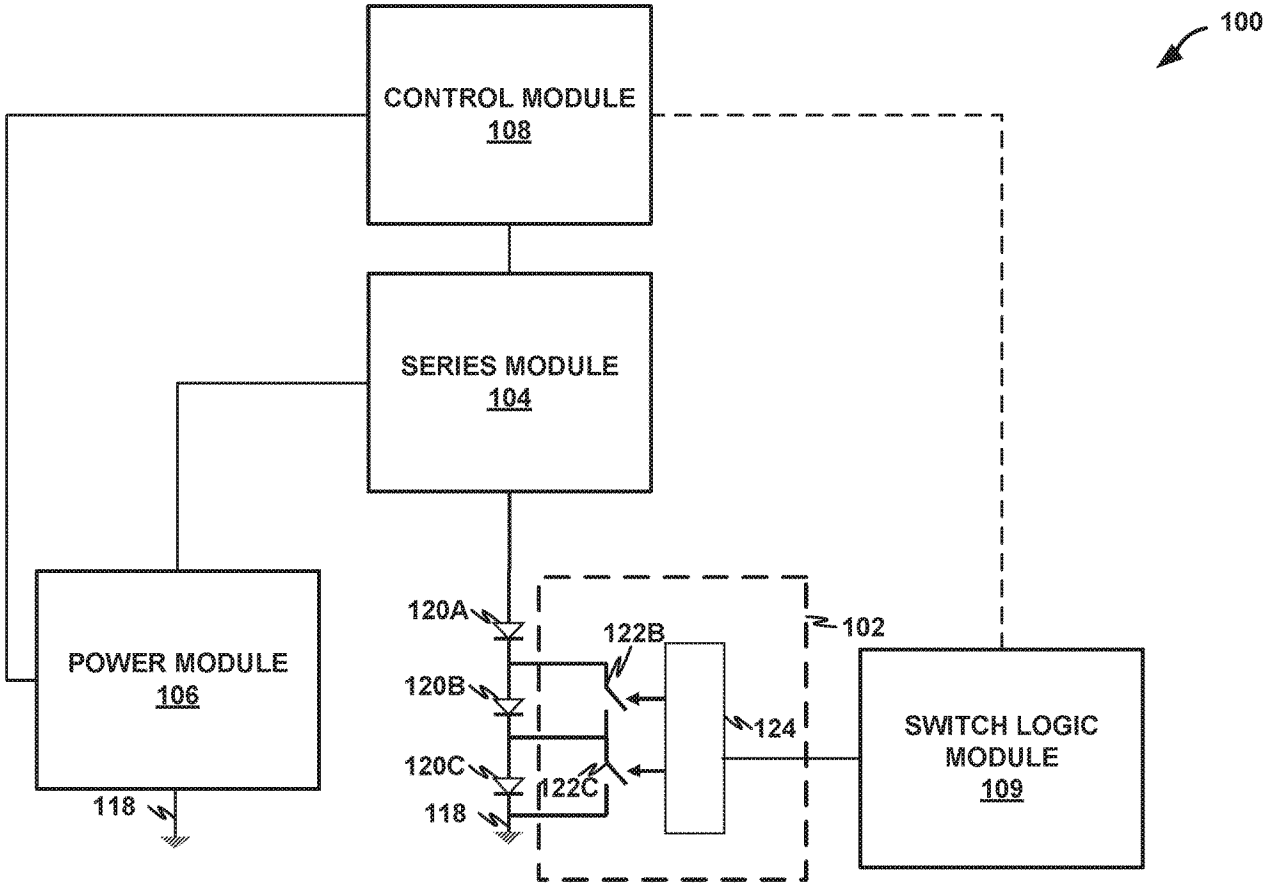
FIG. 1 is a first block diagram illustrating an example system configured to limit an amount of power at light emitting diodes, in accordance with one or more techniques of this disclosure.

FIG. 1 is a first block diagram illustrating an example system 100 configured to limit an amount of power at LEDs 120A-C (collectively, LEDs 120), in accordance with one or more techniques of this disclosure. As illustrated in this example of FIG. 1, system 100 may include load module 102, series module 104, power module 106, control module 108, switch logic module 109, and reference node 118. In some examples, reference node 118 may be a ground, earth ground, ground plane, or another reference point of system 100.

LEDs 120 may refer to any semiconductor light source. In some examples, LEDs 120 may include a p-n junction configured to emit light when activated. In an exemplary application, LEDs 120 may be included in a headlight assembly for automotive applications. For instance, LEDs 120 may be a matrix of LEDs to light the road ahead of an automotive vehicle. In some examples, LEDs 120 may be associated with one or more beam settings. For example, load module 102 may be configured to operate a first combination of LEDs 120 to operate in a low beam setting and to operate a second combination of LEDs 120 to operate in a high beam setting. In some instances, a beam setting of LEDs 120 may be digitally controlled, for example, by load module 102, for adaptive functionality. For instance, in the automotive examples, in response to system 100 detecting oncoming automobiles, system 100 may change LEDs 120 from operating in a high beam setting to a low beam setting and in response to system 100 detecting no oncoming automobiles, system 100 may change LEDs 120 from operating in the low beam setting to the high beam setting. Although FIG. 1 illustrates system 100 as including three LEDs 120, system 100 may include any suitable number of LEDs 120. For example, system 100 may include fewer LEDs 120 (e.g., only LED 120A, only LED 120B, only LEDs 120A and 120B) or more LEDs 120 (e.g., four, five, six, or more). Additionally, although FIG. 1 illustrates a load comprising light emitting didoes 120, in other examples, a different load may be used.

Load module 102 may include switching elements 122B and 122C (collectively switching elements 122), and a multifunctional switching unit 124. Although FIG. 1 illustrates load module 102 as including two switching elements 122, load module 102 may include any suitable number of switching elements 122. For example, load module 102 may include fewer switching elements 122 (e.g., only switching element 122B, only switching element 122C) or more switching elements 122 (e.g., four, five, six, or more). In some examples, LED 120A may have a corresponding switching element 122A. Although, the exemplary load module 102 of FIG. 1 illustrates load module 102 as including multifunctional switching unit 124, in some examples, multifunctional switching unit 124 may be omitted.

Switching elements 122 may include any device suitable to permit current to bypass a corresponding load unit of LEDs 120. For example, switching element 122B may be switched in such that current output from LED 120A flows through switching element 122B instead of LED 120B. Examples of switching elements 122 may include, but are not limited to, silicon controlled rectifier (SCR), a Field Effect Transistor (FET), and bipolar junction transistor (BJT). Examples of FETs may include, but are not limited to, junction field-effect transistor (JFET), metal-oxide-semiconductor FET (MOSFET), dual-gate MOSFET, insulated-gate bipolar transistor (IGBT), any other type of FET, or any combination of the same. Examples of MOSFETS may include, but are not limited to, PMOS, NMOS, DMOS, or any other type of MOSFET, or any combination of the same. Examples of BJTs may include, but are not limited to, PNP, NPN, heterojunction, or any other type of BJT, or any combination of the same. It should be understood that switching elements 122 may be a high side switch or low side switch. Additionally, switching elements 122 may be voltage-controlled and/or current-controlled. Examples of current-controlled switching elements may include, but are not limited to, gallium nitride (GaN) MOSFETs, BJTs, or other current-controlled elements.

Multifunctional switching unit 124 may be configured to drive switching elements 122. For example, multifunctional switching unit 124 may include one or more driver circuits configured to deactivate (e.g., switch out) and activate (e.g., switch in) each switching element of switching elements 122. In some examples, multifunctional switching unit 124 may drive switching elements 122 according to a signal received from switch logic module 109. For example, in response to multifunctional switching unit 124 receiving an instruction to switch in switching elements 122A and B and switch out switching element 122C, multifunctional switching unit 124 may drive a first signal (e.g., high voltage) to a control node (e.g., gate) of switching elements 122A and 122B to switch in switching elements 122A and 122B and may drive a second signal (e.g., low voltage) to a control node (e.g., gate) of switching element 122C to switch out switching element 122C.

Switch logic module 109 may be configured to determine a target quantity number of LEDs 120 used to form the series string of load units. Switch logic module 109 may receive (e.g., from a user interaction with system 100) an indication to change a beam setting of the system 100 from a high beam setting to a low beam setting. In another example, switch logic module 109 may determine to change a beam setting of the system 100 from a high beam setting to a low beam setting in response to sensor data indicating an oncoming automobile. In any case, in response to determining a beam setting of system 100, switch logic module 109 may determine a quantity number of load units corresponding to the beam setting. For instance, switch logic module 109 may determine that the target quantity number of LEDs 120 used to form the series string of load units is one when the low beam setting is associated with only LED 120A and switch logic module 109 may determine that the target quantity number of LEDs 120 used to form the series string of load units is three when the high beam setting is associated with LEDs 120A-C. In some examples, switch logic module 109 may include an analog circuit. In some examples, switch logic module 109 may be a digital circuit comprising one or more logic elements and/or timing elements.

Switch logic module 109 may be configured to generate a switching signal that controls load module 102 to switch in and switch out LEDs 120. For example, switch logic module 109 may output, to load module 102, a switching signal that drives switching element 122B to activate, thereby bypassing LED 120B. In another example, switch logic module 109 may output, to load module 102, a switching signal that drives switching element 122C to activate, thereby bypassing LED 120C.

Switch logic module 109 may be configured to generate a reference signal indicating a target power to output at LEDs 120 based on a target quantity number of LEDs 120. For example, switch logic module 109 may determine an indication of a target quantity number of LEDs 120 that are not bypassed by load module 102. In this example, switch logic module 109 may generate a reference signal for output to control module 108 based on the target quantity number of LEDs 120. For instance, switch logic module 109 may increase the reference signal as the quantity number of LEDs 120 that are not bypassed by load module 102 increases and decrease the reference signal as the quantity number of LEDs 120 that are not bypassed by load module 102 decreases.

Control module 108 may be configured to drive series module 104 to limit a maximum power at LEDs 120. For example, control module 108 may drive a switching element of series module 104 to increase an amount of power dissipated at series module 104 when a power at LEDs 120 is greater than a threshold. In this example, control module 108 may drive the switching element of series module 104 to reduce an amount of power dissipated at series module 104 when a power at LEDs 120 is less than the threshold.

Control module 108 may be configured to generate an indication of a target power based on a reference signal. For example, control module 108 may optionally receive, from switch logic module 109, a reference signal indicating an amount of power to be delivered to LEDs 120. For instance, control module 108 may increase the target power as the reference signal increases and decrease the target power as the reference signal decreases. Additionally, or alternatively, control module 108 may optionally receive, from switch logic module 109, a reference signal indicating an amount of power to be dissipated by series module 104.

Power module 106 may be configured to output a supply power to series module 104. In some examples, power module 106 may be or include a DC to DC power converter. In some examples, power module 106 may be configured to generate the supply power based on an indication of a target power. For instance, power module 106 may be configured to generate the supply power based on a target power output by control module 108. Power module 106 may include one or more switch-mode power converters including, but are not limited to, flyback, buck-boost, buck, Ćuk, or the like. Power module 106 may include one or more switching elements to switch in and out one or more energy storage components (e.g., inductor, capacitor, or another energy storage component).

Series module 104 may be configured to receive a supply voltage and to output a load power. For example, series module 104 may be configured to receive the supply voltage from voltage module 106 and to output the load power to a subset of LEDs 120 that are not bypassed by load module 102. In some examples, series module 104 may include a switching element, such as, for instance, but not limited to, a MOSFET. In some examples, series module 104 may include a driver for driving the switching element.

In accordance with one or more techniques, series module 104 may be configured to limit an amount of power at the LEDs 120. For example, series module 104 may be configured to receive a supply power from power module 106. In this example, series module 104 may modify a resistance of the series module 104 to dissipate a portion of the supply power. In this example, series module 104 may be configured to output a remaining portion of the supply power as a load power to LEDs 120. In this manner, series module 104 may prevent power module 106 from supplying a an amount of power to LEDs 120 that causes a damaging current at LEDs 120.

Figure 2:
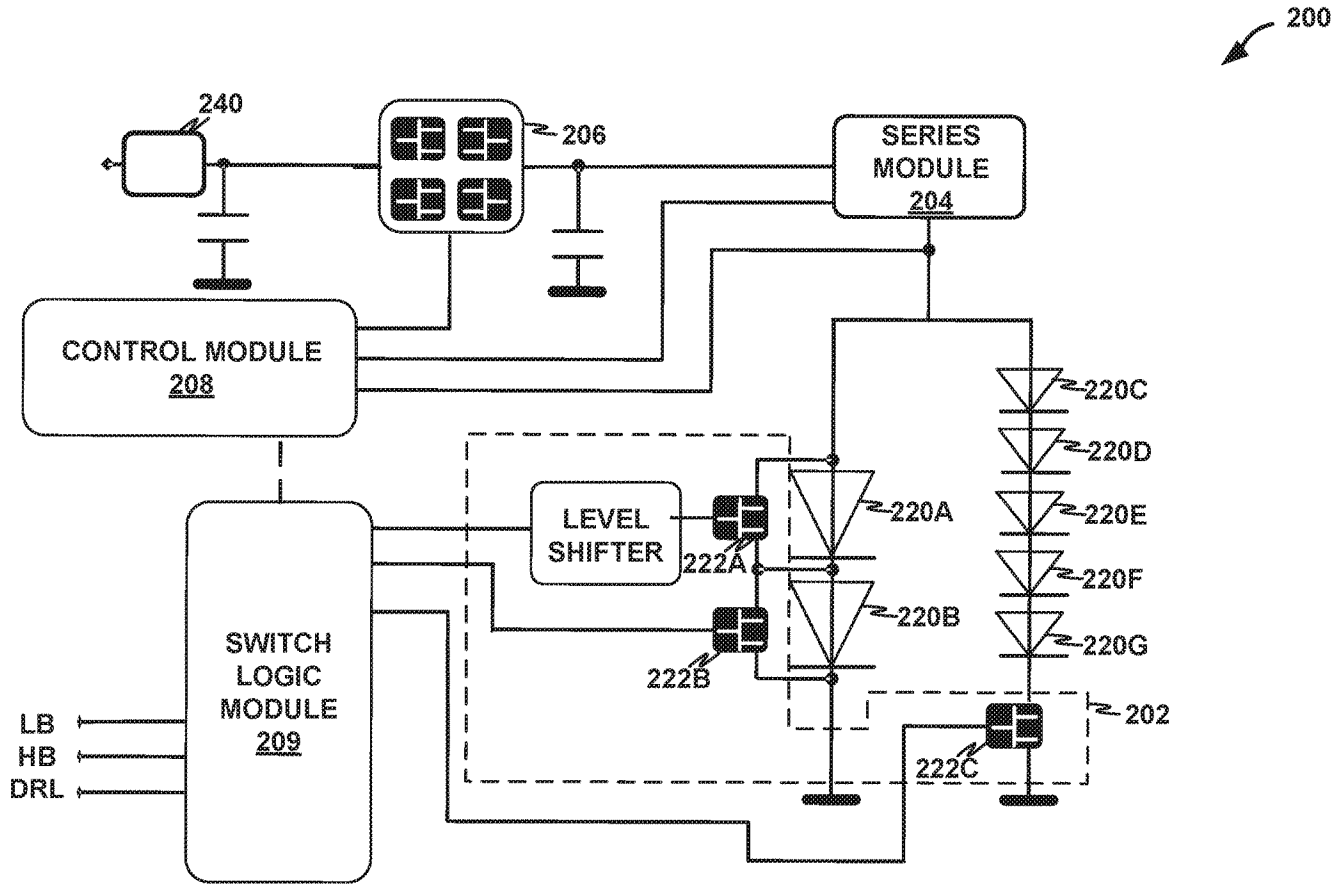
FIG. 2 is a conceptual diagram illustrating an example circuit of the system of FIG. 1, in accordance with one or more techniques of this disclosure.

FIG. 2 is a conceptual diagram illustrating an example circuit 200 of the system of FIG. 1, in accordance with one or more techniques of this disclosure. As illustrated, circuit 200 includes load module 202, series module 204, power module 206, control module 208, switch logic module 209, and LEDs 220A-G (collectively, LEDs 220). Series module 204 may be an example of series module 104 of FIG. 1. Control module 208 may be an example of control module 108 of FIG. 1. LEDs 220A-G may be an example of LEDs 120 of FIG. 1.

Power module 206 may be configured to receive power from supply 240. Examples of supply 240 may include, an output of a rectifier, an output of a DC regulator, a battery output, or another voltage that is substantially DC. Power module 206 may be configured to buck (e.g., decrease) and/or boost a voltage from supply 240 into a voltage suitable for output as a supply power to series module 204. In some examples, power module 206 may modify the supply power based on a target power. For example, in response to receiving a target power from control module 208, power module 206 may generate the supply power to be proportional to the target power.

Load module 202 may be configured to operate switching elements 222A-G (collectively, switching elements 222) for operating LEDs 220 at different beam settings. For example, load module 202 may activate switching element 222C to activate LEDs 220C-G as daylight running light lamps. In another example, load module 202 may activate switching element 222A to activate LED 220A as a low beam lamp. In another example, load module 202 may activate switching element 222B to activate LED 220B as a high beam lamp.

Switch logic module 209 may be configured to receive an instruction indicating an operational state (e.g., switched in, switched out) for each switching element of switching elements 222. For example, switch logic module 209 may output, to load module 202, a gate signal that activates switching element 222C to operate LEDs 220C-G as daylight running lights when receiving an indication to operate daylight running lights ("DRL"). In another example, switch logic module 209 may output, to load module 202, a gate signal that activates switching element 222A to operate LED 220A as a low beam lamp when receiving an indication to operate a low beam ("LB"). In another example, switch logic module 209 may output, to load module 202, a gate signal that activates switching element 222B to operate LED 220B as a high beam lamp when receiving an indication to operate a high beam ("HB").

Figure 3:
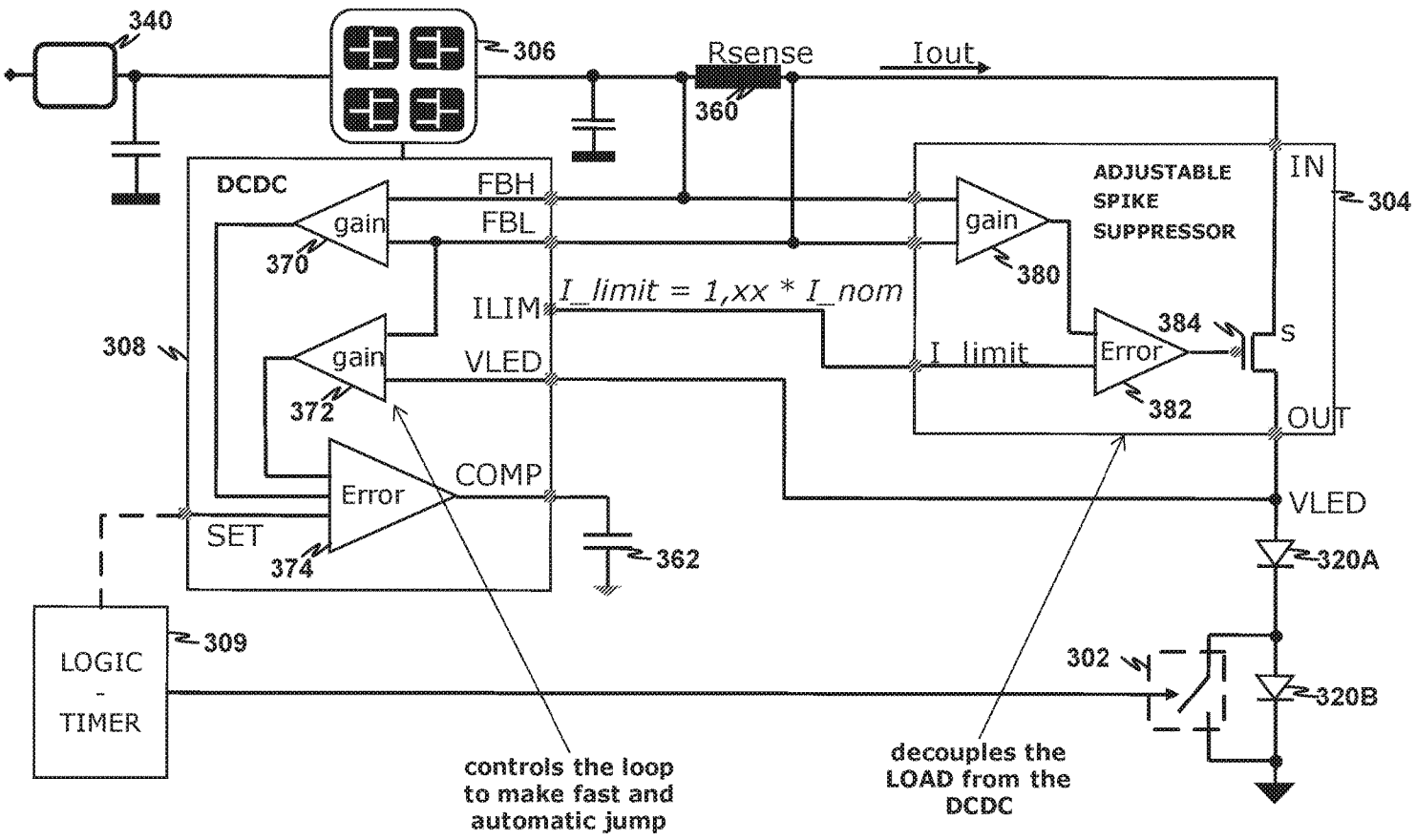
FIG. 3 is a circuit diagram illustrating an example circuit of the system of FIG. 1, in accordance with one or more techniques of this disclosure.

FIG. 3 is a circuit diagram illustrating an example circuit 300 of system 100 of FIG. 1, in accordance with one or more techniques of this disclosure. As illustrated, circuit 300 includes load module 302, series module 304, power module 306, control module 308, switch logic module 309, and LEDs 320A-B (collectively, LEDs 320). Load module 302 may be an example of load module 102 of FIG. 1. Power module 306 may be an example of power module 106 of FIG. 1. Switch logic module 309 may be an example of switch logic module 109 of FIG. 1. LEDs 320 may be an example of LEDs 120 of FIG. 1.

Series module 304 may be configured to limit the amount of power at LEDs 320 such that the amount of power at LEDs 320 is less than a maximum power threshold. For example, gain amplifier 380 may generate an indication of a power at LEDs 320 based on a voltage at resistor 360. In this example, error amplifier 382 may generate a gate signal for driving switching element 384 based on the indication of power at LEDs 320 and a maximum power threshold output by control module 308. More specifically, error amplifier 382 may generate, based on the maximum power threshold and the indication of the power at LEDs 320, a gate signal that modifies a resistance of switching element 384 such that the amount of power at LEDs 320 is less than the maximum power threshold. For instance, error amplifier 382 may generate a gate signal that causes switching element 384 to increase a resistance of series module 304 to prevent the power at LEDs 320 from exceeding the maximum power threshold.

Series module 304 may be configured to regulate an amount of power at LEDs 320 such that the amount of power at LEDs 320 corresponds to a target power. For example, gain amplifier 380 may generate an indication of a power at LEDs 320 based on a voltage at resistor 360. In this example, error amplifier 382 may generate a gate signal for driving switching element 384 based on the indication of power at LEDs 320 and a target power output by control module 308. More specifically, error amplifier 382 may generate, based on the target power and the indication of the power at LEDs 320, a gate signal that modifies a resistance of switching element 384 such that the amount of power output at LEDs 320 corresponds to the target power. For instance, error amplifier 382 may generate a gate signal that causes switching element 384 to increase a resistance of series module 304 when the power at LEDs 320 exceeds the target power and to decrease the resistance of series module 304 when the power at LEDs 320 does not exceed the target power.

Power module 306 may be configured to output a supply power that is based on a voltage at compensation capacitor 362. For example, a modulator of power module 306 may generate a duty cycle of a pulse width modulation signal for generating the supply power from a voltage output by supply 340 based on a comparison of a voltage at compensation capacitor 362 and a reference signal. Examples of a reference signal may include, but are not limited to, a triangle signal (e.g., sawtooth). For instance, a modulator may output a first signal (e.g., high signal) to cause power module 306 to energize one or more energy storage elements when a voltage at compensation capacitor 362 is greater than an instantaneous voltage of an offset triangle signal (e.g., sawtooth). In some instances, the modulator may output a second signal (e.g., low signal) to cause power module 306 to switch out (e.g., refrain from energizing, de-energize, etc.) the one or more energy storage elements when the voltage at compensation capacitor 362 is less than or equal to an instantaneous voltage of the offset triangle signal.

Control module 308 may be configured to modify an energy level of compensation capacitor 362 based on an indication of a portion of the supply power that is dissipated at series module 304. For example, control module 308 may reduce an energy level of compensation capacitor 362 when the indication of the voltage at series module 304 corresponds to a voltage that exceeds a voltage threshold. The voltage threshold may be predefined to be greater than a drain-to-source voltage at switching element 384 when switching element 384 is operating in an active mode. More specifically, for example, gain amplifier 372 may generate an indication of a voltage at series module 304 based on a voltage at series module 304. In this example, error amplifier 374 may modify, based on the voltage threshold and the indication of the voltage at series module 304, the energy level of compensation capacitor 362. For instance, error amplifier 374 may reduce the energy level of compensation capacitor 362 (e.g., by reducing energy provided to compensation capacitor 362) when the indication of the voltage at series module 304 is greater than the voltage threshold and may increase the energy level of compensation capacitor 362 (e.g., by increasing energy provided to compensation capacitor 362) when the indication of the voltage at series module 304 is less than the voltage threshold.

Control module 308 may be configured to modify an energy level of compensation capacitor 362 based on an indication of a power at LEDs 320. For example, control module 308 may reduce an energy level of compensation capacitor 362 when the indication of the power at LEDs 320 corresponds to a power that exceeds a power threshold. The power threshold may be a maximum power threshold, a target power, or another power threshold. More specifically, for example, gain amplifier 370 may generate an indication of a power at LEDs 320 based on a voltage at resistor 360. In this example, error amplifier 374 may modify, based on the power threshold and the indication of the power at LEDs 320, the energy level of compensation capacitor 362. For instance, error amplifier 374 may reduce the energy level of compensation capacitor 362 when the indication of the power at LEDs 320 is greater than the power threshold and may increase the energy level of compensation capacitor 362 when the indication of the power at LEDs 320 is less than the power threshold.

Figure 4:
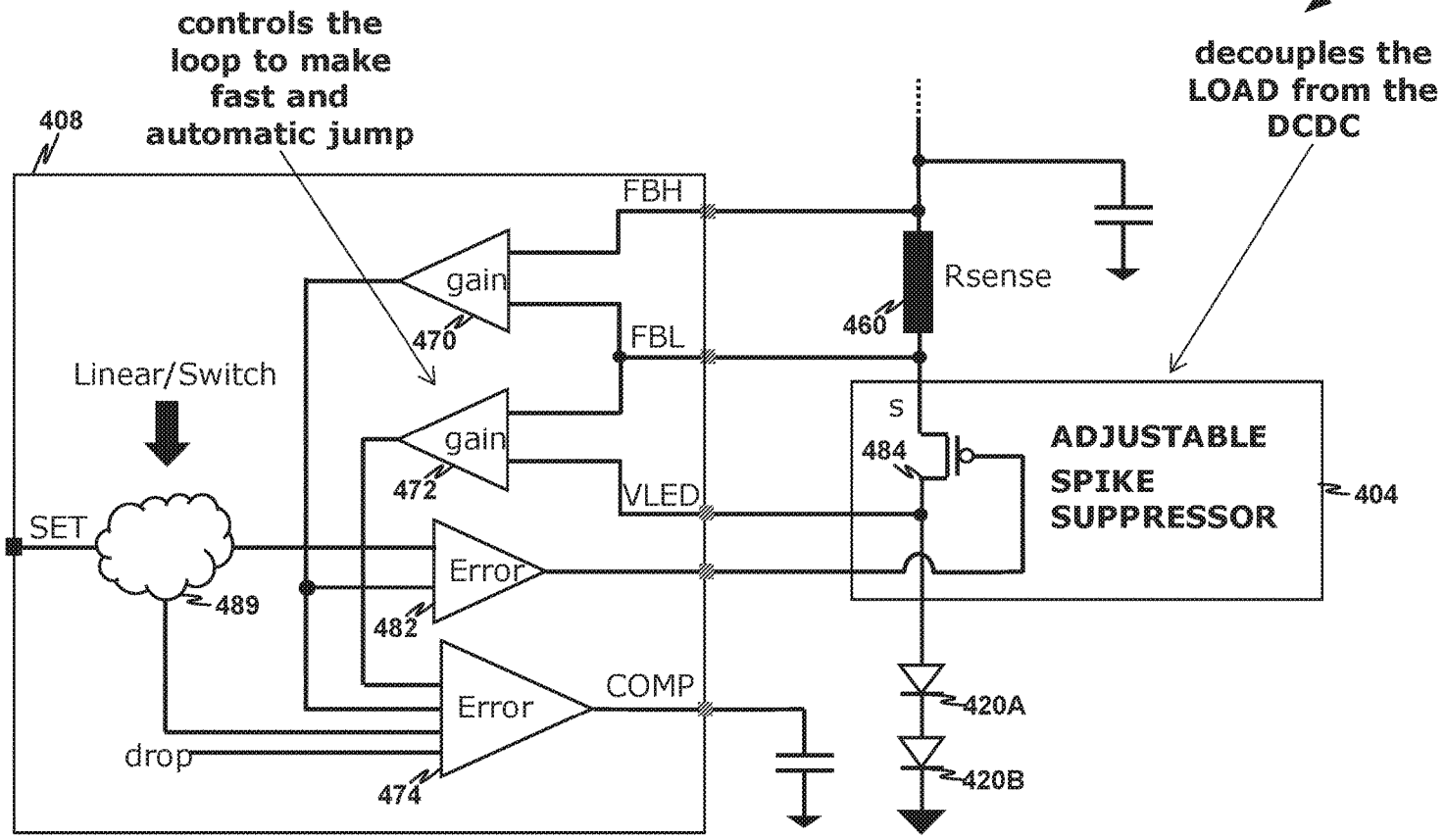
FIG. 4 is a circuit diagram illustrating an example series module and control module of the system of FIG. 1, in accordance with one or more techniques of this disclosure.

FIG. 4 is a circuit diagram illustrating an example series module 404 and control module 408 of system 100 of FIG. 1, in accordance with one or more techniques of this disclosure. Although not illustrated, it should be understood that circuit 400 may include other modules, for instance, a load module, power module, and switch logic module, as described in FIG. 1.

Control module 408 may be configured to include a driver for series module 404. For example, control module 408 may include gain amplifier 470 that is substantially similar to gain amplifier 370 of FIG. 3, gain amplifier 472 that is substantially similar to gain amplifier 372 of FIG. 3, and error amplifier 474 that is substantially similar to error amplifier 374 of FIG. 3. However, control module 408 may further include logic module 489 and error amplifier 482. Logic module 489 may be configured to generate first and second power thresholds based on a received reference signal indicating a target power. Logic module 489 may include an analog circuit. In some examples, logic module 489 may be a digital circuit comprising one or more logic elements and/or timing elements.

Control module 408 may generate a control signal for driving switching element 484 of series module 404 based on an indication of power at LEDs 420A-B (collectively, LEDs 420) output by gain amplifier 470 and a power threshold. For example, gain amplifier 470 may generate an indication of a power at LEDs 420 based on a voltage at resistor 460. In this example, error amplifier 482 may generate the control signal based on the indication of the power at LEDs 420 and a power threshold. In this example, series module 404 may be configured to modify a resistance of series module 404 based on the control signal. In this manner, components of series module 404 may be integrated into control module 408 to reduce a number of components in a resulting device.

Figure 5:
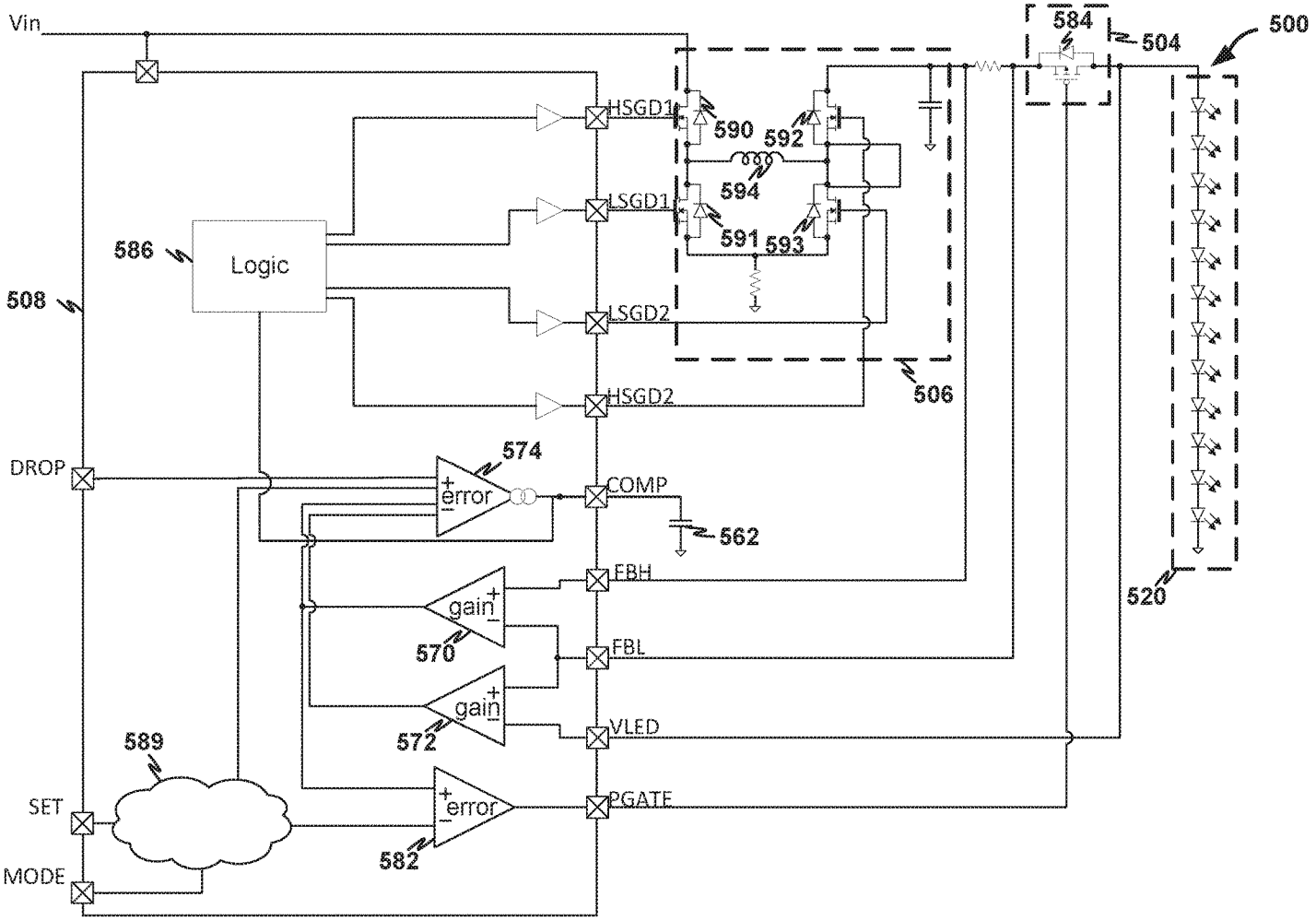
FIG. 5 is a circuit diagram illustrating an example circuit of the system of FIG. 1 having analog control, in accordance with one or more techniques of this disclosure.

FIG. 5 is a circuit diagram illustrating an example circuit 500 of system 100 of FIG. 1 having analog control, in accordance with one or more techniques of this disclosure. As illustrated, circuit 500 may include series module 504, power module 506, control module 508, logic module 589, and LEDs 520. Series module 504 may be an example of series module 104 of FIG. 1. Logic module 589 may be an example of logic module 489 of FIG. 4. LEDs 520 may be an example of LEDs 120 of FIG. 1. Although not illustrated, it should be understood that circuit 500 may include other modules, for instance, a load module described in FIG. 1.

Control module 508 may be configured to include a driver for series module 504. For example, control module 508 may include gain amplifier 570 that is substantially similar to gain amplifier 470 of FIG. 4, gain amplifier 572 that is substantially similar to gain amplifier 472 of FIG. 4, error amplifier 574 that is substantially similar to error amplifier 474 of FIG. 4, and error amplifier 582 that is substantially similar to error amplifier 482 of FIG. 4. However, logic module 589 may further be configured to use a mode and control module 508 may further include voltage control logic 586. In some examples, control module 508 may be an analog circuit. For instance, logic module 589, gain amplifier 570, gain amplifier 572, error amplifier 474, error amplifier 482, and voltage control logic 586 may each include analog components and omit digital components. Examples of analog components may include, but are not limited to, operational amplifiers, switching elements, diodes, and other analog components. Examples of digital components may include, but are not limited to, logic gates, microprocessors, microcontrollers, and other digital components.

Logic module 589 may be configured to generate a power threshold based on a mode and an indication of a reference power. For example, logic module 589 may receive an indication of a selection of a mode ("MODE" of FIG. 5) and an indication of a reference power ("SET" of FIG. 5). Examples of modes may include, but are not limited to, limit the amount of power at LEDs 520 such that the amount of power at LEDs 520 is less than a maximum power threshold, regulate an amount of power at LEDs 520 such that the amount of power at LEDs 320 corresponds to a target power, and other modes. In some examples, logic module 589 may be an analog circuit. For instance, logic module 589 may include analog components and omit digital components.

Logic module 589 may be configured to operate in a mode to limit the amount of power at LEDs 520 such that the amount of power at LEDs 520 is less than a maximum power threshold. For example, logic module 589 may receive at a "SET" input an indication of a maximum reference power and at a "MODE" input an indication of an instruction to limit the amount of power at LEDs 520 such that the amount of power at LEDs 520 is less than the maximum reference power. For instance, a logical high value ('1') at the "MODE" input may indicate an instruction to limit the amount of power at LEDs 520 such that the amount of power at LEDs 520 is less than the maximum reference power. In some instances, a voltage at "SET" input may correspond to a setting of the maximum power threshold. In this example, logic module 589 may output a power threshold to error amplifier 582 that is less than the maximum reference power. For instance, the power threshold may be between 70% to 95% of the maximum reference power. In this example, error amplifier 582 may generate a gate signal for driving switching element 584 based on the indication of power at LEDs 520 output by gain amplifier 570 and the power threshold output by logic module 589. More specifically, error amplifier 582 may cause switching element 584 to modify, based on the power threshold and the indication of the power, a resistance of switching element 584 such that the amount of power at LEDs 520 is less than the indication of the maximum reference power. For instance, error amplifier 582 may generate a gate signal that causes switching element 584 to increase a resistance of series module 504 to prevent the power at LEDs 520 from exceeding the maximum reference power.

Logic module 589 may be configured to operate in a mode to regulate an amount of power at LEDs 520 such that the amount of power at LEDs 520 corresponds to a target power. For example, logic module 589 may receive at a "SET" input an indication of a target reference power and at a "MODE" input an indication of an instruction to regulate an amount of power at LEDs 520 such that the amount of power at LEDs 520 corresponds to the target reference power. For instance, a logical high value ('0') at the "MODE" input may indicate an instruction to limit the amount of power at LEDs 520 such that the amount of power at LEDs 520 corresponds to the target reference power. In some instances, a voltage at "SET" input may correspond to a setting of the target power. In this example, logic module 589 may output a target power to error amplifier 582 that is approximately equal to or greater than the target reference power. For instance, the target power may be between 95% to 125% of the target reference power. In this example, error amplifier 582 may generate a gate signal for driving switching element 584 based on the indication of power at LEDs 520 output by gain amplifier 570 and the target threshold power output by logic module 589. More specifically, error amplifier 582 may cause switching element 584 to modify, based on the target power and the indication of the power, a resistance of switching element 584 such that the amount of power at LEDs 520 corresponds to the target reference power. For instance, error amplifier 582 may generate a gate signal that causes switching element 584 to increase a resistance of series module 504 to control the amount of power at LEDs 520 to correspond to the target reference power.

Voltage control logic 586 may be configured to selectively drive switching elements 590-593 based on a voltage at compensation capacitor 562. For example, a modulator of voltage control logic 586 may generate a duty cycle of a pulse width modulation signal for generating the supply power based on a comparison of a voltage at compensation capacitor 562 and a reference signal. For instance, the modulator of voltage control logic 586 may output a first signal (e.g., high signal) to cause switching elements 590-593 to energize inductor 594 when a voltage at compensation capacitor 562 is greater than an instantaneous voltage of an offset triangle signal (e.g., sawtooth). In some instances, the modulator of voltage control logic 586 may output a second signal (e.g., low signal) to cause switching elements 590-593 to switch out (e.g., de-energize, refrain from energizing, etc.) inductor 594 when the voltage at compensation capacitor 562 is less than or equal to an instantaneous voltage of the offset triangle signal.

Voltage control logic 586 may be configured to actively discharge inductor 594. For example, in response to determining that a next target power is less than a previous target power, voltage control logic 586 may deactivate a control loop and instead apply an active discharge of voltage through inductor 594 to ground, thereby altering the voltage at the output of voltage converter 506 from a first supply power to a second supply power.

Figure 6:
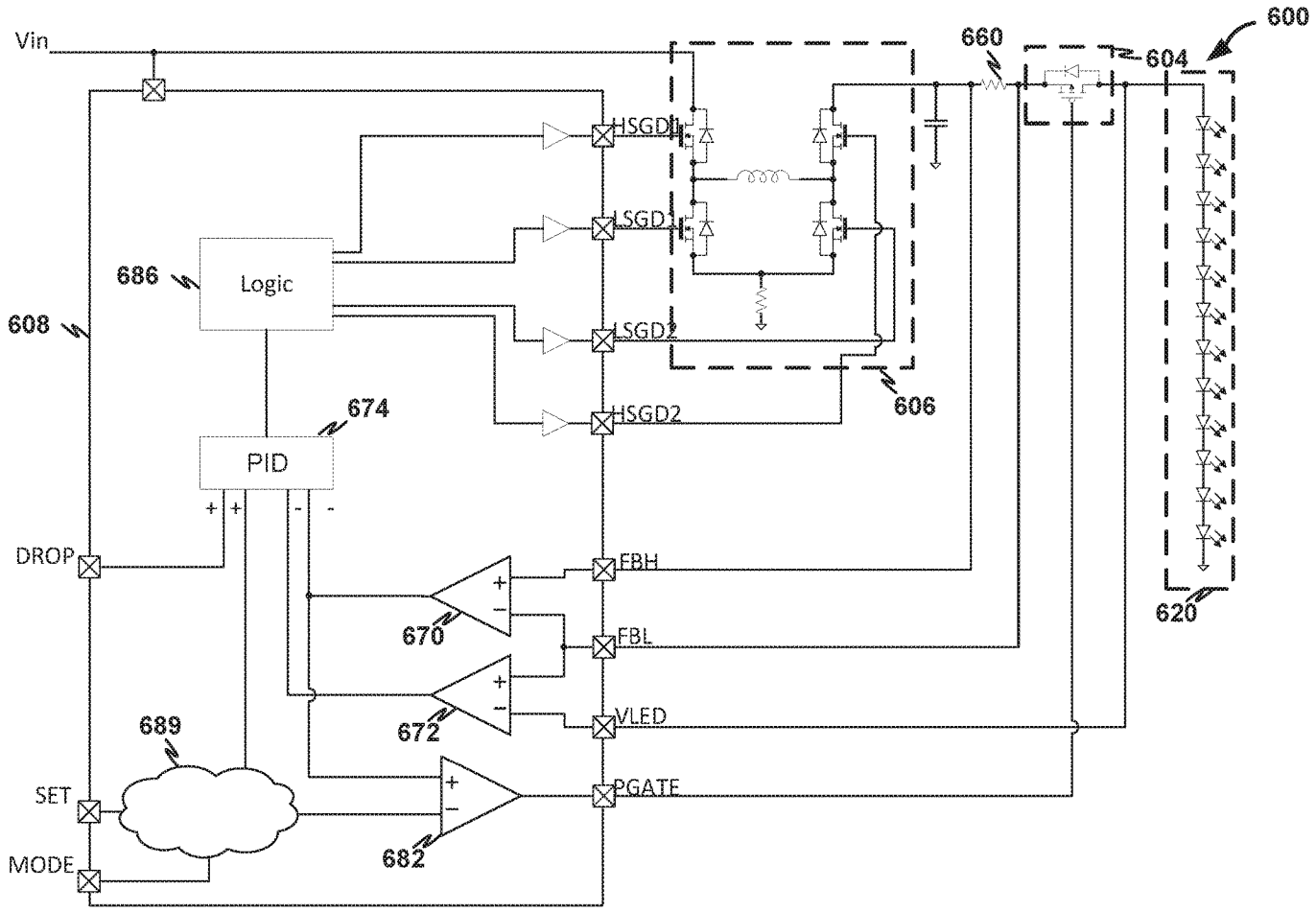
FIG. 6 is a circuit diagram illustrating an example circuit of the system of FIG. 1 having digital control, in accordance with one or more techniques of this disclosure.

FIG. 6 is a circuit diagram illustrating an example circuit 600 of system 100 of FIG. 1 having digital control, in accordance with one or more techniques of this disclosure. As illustrated, circuit 600 may include series module 604, power module 606, control module 608, logic module 689, and LEDs 620. Series module 604 may be an example of series module 104 of FIG. 1. Power module 606 may be substantially similar to power module 506 of FIG. 5. Logic module 689 may be an example of logic module 489 of FIG. 1. LEDs 620 may be an example of LEDs 120 of FIG. 1. Although not illustrated, it should be understood that circuit 500 may include other modules, for instance, a load module described in FIG. 1.

Control module 608 may be configured to include a driver for series module 604. For example, control module 608 may include gain amplifier 670 that is substantially similar to gain amplifier 570 of FIG. 5, gain amplifier 672 that is substantially similar to gain amplifier 572 of FIG. 5, and error amplifier 682 that is substantially similar to error amplifier 582 of FIG. 5. However, control module 608 may further include proportional-integral-derivative controller 674. In some examples, control module 508 may include a digital circuit. For instance, proportional-integral-derivative controller 674 may each include digital components.

Proportional-integral-derivative controller 674 may be configured to generate an indication of a target power based on a power at series module 604. For example, gain amplifier 672 may generate an indication of a power at series module 604 based on a voltage at series module 604. In this example, proportional-integral-derivative controller 674 may reduce the target power when the voltage at series module 604 exceeds a voltage drop threshold ("DROP").

Logic module 689 may be substantially similar to logic module 589 of FIG. 5. For example, logic module 689 may be configured to operate in a mode to limit the amount of power at LEDs 620 such that the amount of power at LEDs 620 is less than a maximum power threshold. In another example, logic module 689 may be configured to operate in a mode to regulate an amount of power at LEDs 620 such that the amount of power at LEDs 620 corresponds to a target power.

Proportional-integral-derivative controller 674 may be configured to generate an indication of a target power based on a power threshold. For example, proportional-integral-derivative controller 674 may receive a power threshold from logic module 689. In this example, gain amplifier 670 may generate an indication of a power at LEDs 620 based on a voltage at resistor 660. In this example, proportional-integral-derivative controller 674 may modify, based on the power threshold and the indication of the of the power at LEDs 620, the target power output to voltage control logic 686. For instance, proportional-integral-derivative controller 674 may decrease the target power output when the power threshold is greater than the indication of the of the power at LEDs 620 and may increase the target power output when the power threshold is less than the indication of the of the power at LEDs 620.

Proportional-integral-derivative controller 674 may be configured to generate an indication of a target power based on a power at series module 604, a power threshold, and an indication of a power at LEDs 620. For example, gain amplifier 672 may generate an indication of a power at series module 604 based on a voltage at series module 604. In this example, gain amplifier 670 may generate an indication of a power at LEDs 620 based on a voltage at resistor 660. In this example, proportional-integral-derivative controller 674 may reduce the target power when the indication of the voltage at series module 604 exceeds a power threshold ("DROP"). In this example, proportional-integral-derivative controller 674 may increase the target power when the indication of the power at series module 604 does not exceed the power threshold ("DROP") and when the power threshold is less than the indication of the of the power at LEDs 620.

Figure 7:
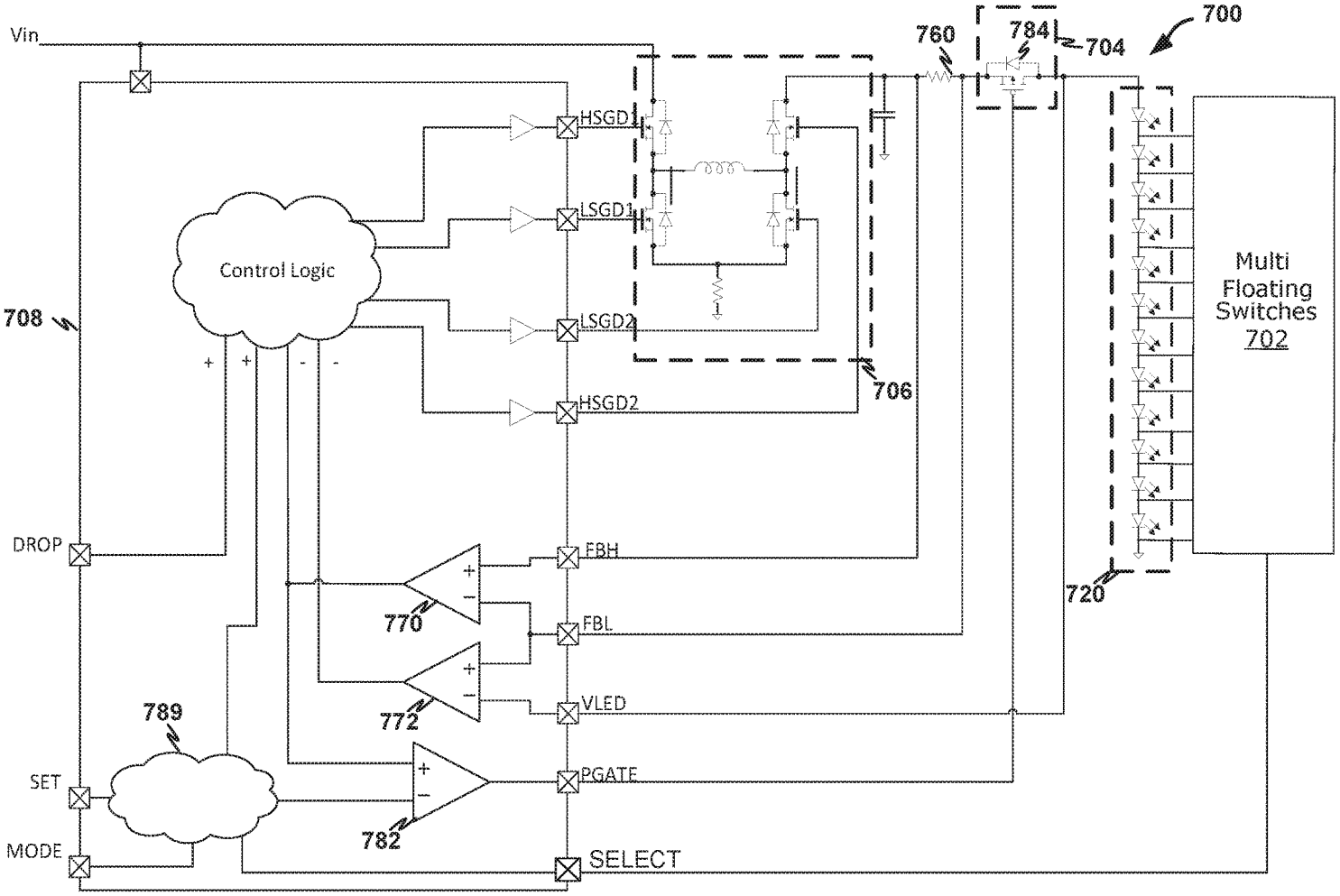
FIG. 7 is a circuit diagram illustrating an example circuit of the system of FIG. 1 having general control, in accordance with one or more techniques of this disclosure.

FIG. 7 is a circuit diagram illustrating an example circuit 700 of system 100 of FIG. 1 having a general control, in accordance with one or more techniques of this disclosure. As illustrated, circuit 700 may include load module 702, series module 704, power module 706, control module 708, logic module 789, and LEDs 720. Series module 704 may be an example of series module 104 of FIG. 1. Power module 706 may be substantially similar to power module 506 of FIG. 5 and/or power module 606 of FIG. 6. Logic module 789 may be an example of logic module 489 of FIG. 1. LEDs 720 may be an example of LEDs 120 of FIG. 1.

Load module 702 may be configured to select a subset LEDs 720 based on a switch signal received from logic module 789. For example, load module 702 may select a quantity of LEDs 720 that are activated (e.g., switched in) based on one or more signals received from logic module 789. For instance, load module 702 activate one or more switching elements to bypass one or more LEDs 720 when the one or more signals received from logic module 789 indicate a lower quantity of LEDs 720 than currently activated.

Series module 704 may be configured to decouple power module 706 from LEDs 720 when load module 702 selects LEDs 720. For example, logic module 789 may set a power threshold to a minimal power threshold when load module 702 selects LEDs 720. The minimal power threshold may be, but not limited to, a power of about 0-5% of a nominal operating power. In this example, error amplifier 782 may increase, based on the power threshold and the indication of a power at LEDs 720 output by gain amplifier 770, a resistance of switching element 784 such that the resistance of switching element 784 electronically decouples power module 706 from LEDs 720.

Figure 8:
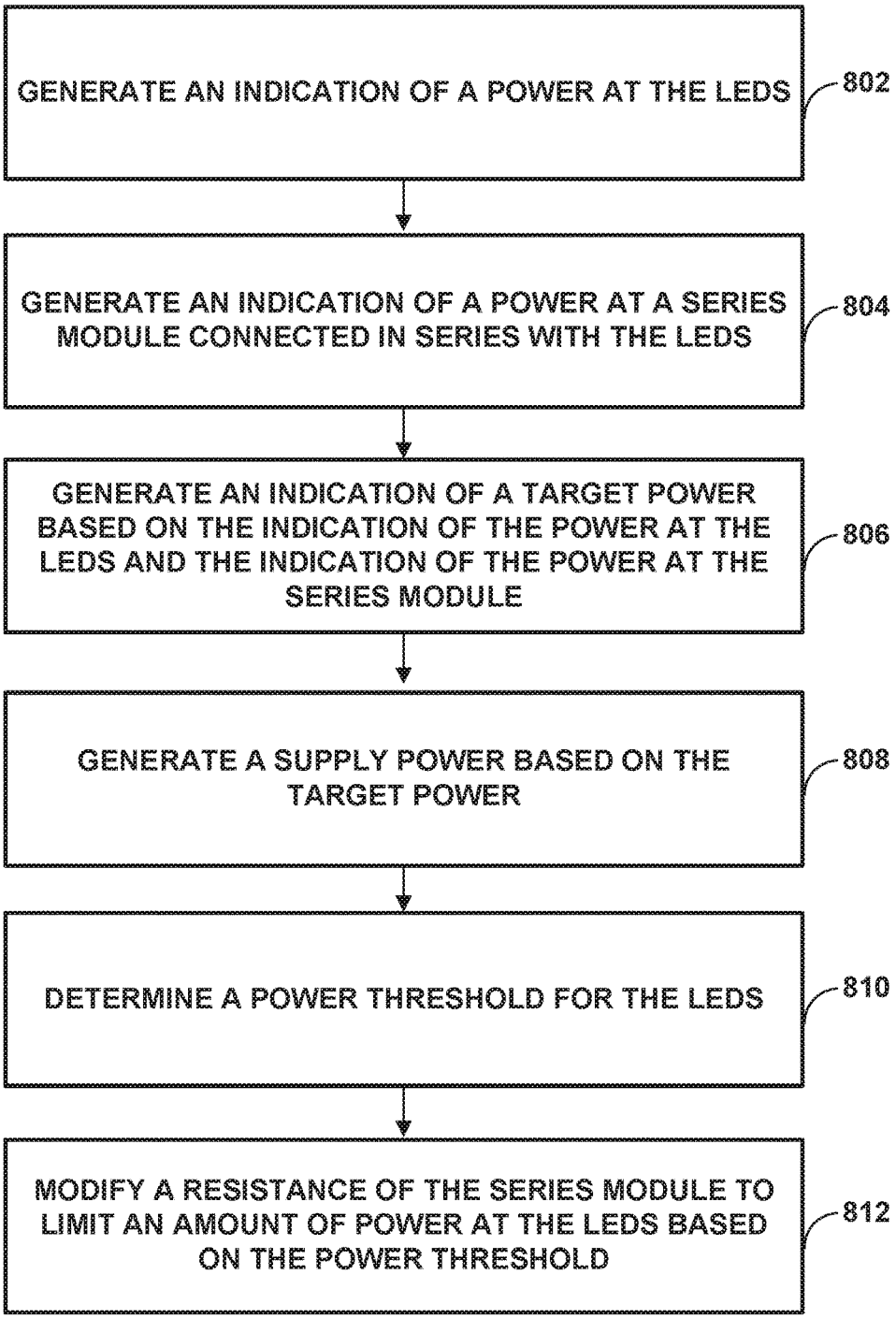
FIG. 8 is a flow diagram consistent with techniques that may be performed by the example system of FIG. 1, in accordance with this disclosure.

FIG. 8 is a flow diagram consistent with techniques that may be performed by the example system of FIG. 1, in accordance with this disclosure. For purposes of illustration only, FIG. 8 is described below within the context of system 100 of FIG. 1, circuit 200 of FIG. 2, circuit 300 of FIG. 3, circuit 400 of FIG. 4, circuit 500 of FIG. 5, circuit 600 of FIG. 6, and circuit 700 of FIG. 7. However, the techniques described below can be used in any permutation, and in any combination, with load module 102, series module 104, power module 106, control module 108, switch logic module 109.

In accordance with one or more techniques of this disclosure, control module 108 generates an indication of a power at LEDs 120 (802). For example, gain amplifier 370 of FIG. 3 generates an indication of a power at LEDs 320 from a voltage at resistor 360. Control module 108 generates an indication of a power at series module 104 (804). For example, gain amplifier 372 of FIG. 3 generates the indication of the power at series module 304.

Control module 108 generates an indication of a target power based on the indication of the power at LEDs 120 and the indication of the power at series module 104 (806). For example, error amplifier 374 of FIG. 3 generates the target power based on the indication of power at LEDs 320 output by gain amplifier 370 and the indication of the power at series module 304 output by gain amplifier 372. More specifically, error amplifier 374 of FIG. 3 may charge compensation capacitor 362 when the indication of the power at series module 304 does not exceeds a voltage threshold and the power at LEDs 120 does not exceed a power indicated by the reference signal. In another example, proportional-integral-derivative controller 674 of FIG. 6 generates the target power based on the indication of power at LEDs 620 output by gain amplifier 670 and the indication of the power at series module 604 output by gain amplifier 672.

Power module 106 generates a supply power based on the target power (808). For example, a modulator of power module 306 of FIG. 3 selects a duty cycle based on a voltage at compensation capacitor 362 of FIG. 3. In this example, power module 306 generates the supply power based on the duty cycle. In another example, voltage control logic 686 of FIG. 6 controls power module 606 of FIG. 6 to generate the supply power based on the target power.

Control module 108 determines a power threshold for LEDs 120 (810). For example, logic module 589 of FIG. 5 receives an indication of the reference power and a mode. In this example, logic module 589 generates, based on the reference power and mode, a power threshold. Series module 104 modifies a resistance of series module 104 to limit an amount of power at LEDs 120 based on the power threshold (812). For example, error amplifier 382 of series module 304 of FIG. 3 may cause switching element 384 to modify a resistance of series module 304 to limit an amount of power at LEDs 320. In another example, error amplifier 482 of control module 408 of FIG. 4 may cause switching element 484 to modify a resistance of series module 404 to limit an amount of power at LEDs 420.

The following examples may illustrate one or more aspects of the disclosure.

EXAMPLE 1

A system comprising: a power module configured to generate a supply power; a load module configured to select a subset of light emitting diodes (LEDs) from a set of LEDs; a series module configured to receive the supply power from the power module, dissipate a portion of the supply power, and output, to the subset of LEDs, a remaining portion of the supply power as a load power; and a control module configured to drive the series module to limit an amount of power at the subset of LEDs.

EXAMPLE 2

The system of example 1, wherein: the control module is further configured to generate a target power based on the portion of the supply power that is dissipated at the series module; and to generate the supply power, the power module is configured to generated the supply power based on the target power.

EXAMPLE 3

The system of any combination of examples 1-2, wherein the series module is configured to dissipate the portion of the supply power such that the load power is less than a maximum power threshold.

EXAMPLE 4

The system of any combination of examples 1-3, wherein: to drive the series module, the control module is configured to output, to the series module, an indication of the maximum power threshold; and to dissipate the portion of the supply power such that the load power is less than a maximum power threshold, the series module is configured to modify, based on the indication of the maximum power threshold, a resistance of the series module such that the load power is less than the maximum power threshold.

EXAMPLE 5

The system of any combination of examples 1-4, wherein the series module is configured to dissipate the portion of the supply power such that the load power corresponds to a target power.

EXAMPLE 6

The system of any combination of examples 1-5, wherein: to drive the series module, the control module is configured to output, to the series module, an indication of the target power; to dissipate the portion of the supply power such that the load power corresponds to a target power, the series module is configured to modify, based on the indication of the target power, a resistance of the series module such the load power corresponds to the target power.

EXAMPLE 7

The system of any combination of examples 1-6, wherein the series module is further configured to decouple the power module from the subset of LEDs when the load module selects the subset of LEDs from the set of LEDs.

EXAMPLE 8

A method comprising: generating, by a power module of a circuit, a supply power; selecting, by a load module of the circuit, a subset of light emitting diodes (LEDs) from a set of LEDs; receiving, by a series module of the circuit, the supply power from the power module; dissipating, by the series module, a portion of the supply power; outputting, by the series module, to the subset of LEDs, a remaining portion of the supply power as a load power; and driving, by a control module of the circuit, the series module to limit the amount of power at the subset of LEDs.

EXAMPLE 9

The method of example 8, further comprising: wherein: generating, by the control module, a target power based on the portion of the supply power that is dissipated at the series module; and generating the supply power is based on the target power.

EXAMPLE 10

The method of any combination of examples 8-9, wherein dissipating the portion of the supply power comprises dissipating, by the series module, the portion of the supply power such that the load power is less than a maximum power threshold.

EXAMPLE 11

The method of any combination of examples 8-10, wherein: driving the series module comprises outputting, by the control module, to the series module, an indication of the maximum power threshold; and dissipating the portion of the supply power such that the load power is less than the maximum power threshold comprises modifying, by the series module, based on the indication of the maximum power threshold, a resistance of the series module such that the load power is less than the maximum power threshold.

EXAMPLE 12

The method of any combination of examples 8-11, wherein dissipating the portion of the supply power comprises dissipating, by the series module, the portion of the supply power such that the load power corresponds to a target power.

EXAMPLE 13

The method of any combination of examples 8-12, wherein: driving the series module comprises outputting, by the control module, to the series module, an indication of the target power; and dissipating the portion of the supply power such that the load power corresponds to the target power comprises modifying, by the series module, based on the indication of the target power, a resistance of the series module such that the amount of power output at the subset of LEDs corresponds to the target power.

EXAMPLE 14

The method of any combination of examples 8-13, further comprising: decoupling, by the series module, the power module from the subset of LEDs when the load module selects the subset of LEDs from the set of LEDs.

EXAMPLE 15

A system comprising: a switch logic module configured to generate a switching signal; a set of light emitting diodes (LEDs); a load module configured to selectively bypass, based on the switching signal, each LED of the set of LEDs to form a subset of LEDs; a power module configured to output a supply power; a series module configured to receive the supply power from the power, dissipate a portion of the supply power, and output, to the subset of LEDs, a remaining portion of the supply power as a load power; and a control module configured to drive the series module to limit an amount of power at the subset of LEDs.

EXAMPLE 16

The system of example 15, wherein: the control module is further configured to generate a target power based on the portion of the supply power that is dissipated at the series module; and to generate the supply power, the power module is configured to generated the supply power based on the target power.

EXAMPLE 17

The system of any combination of examples 15-16, wherein to dissipate the portion of the supply power, the series module is configured to: receive an indication of the load power; receive an indication of a power threshold; and modify a resistance of the series module based on the indication of the load power and the power threshold.

EXAMPLE 18

The system of any combination of examples 15-17, wherein: the control module is configured to: receive an indication of the load power; receive an indication of a power threshold; and generate a control signal based on the indication of the load power and the power threshold; and to dissipate the portion of the supply power, the series module is configured to modify a resistance of the series module based on the control signal.

EXAMPLE 19

The system of any combination of examples 15-18, wherein a logic module is configured to: receive an indication of a selection of a mode and an indication of a reference power; generate the power threshold based on the indication of the selection of the mode and the indication of the reference power; and output, to the control module, the indication of the power threshold.

EXAMPLE 20

The system of any combination of examples 15-19, wherein the series module is further configured to decouple the power module from the subset of LEDs when the load module selectively bypasses each LED of the set of LEDs to form the subset of LEDs.

Various aspects have been described in this disclosure. These and other aspects are within the scope of the following claims.

The invention claimed is:

1. A system comprising:

a power module configured to generate a supply power;

a load module configured to select a subset of light emitting diodes (LEDs) from a set of LEDs;

a series module configured to receive the supply power from the power module, dissipate a portion of the supply power, and output, to the subset of LEDs, a remaining portion of the supply power as a load power; and a control module configured to drive the series module to limit an amount of power at the subset of LEDs, wherein, to drive the series module, the control module is configured to output, to the series module, an indication of a power threshold or control signal, and wherein, to dissipate the portion of the supply power, the series module is configured to modify, based on the indication of the power threshold or control signal, a resistance of a switching element of the series module such that the resistance of the switching element dissipates the portion of the supply power and directly outputs the remaining portion of the supply power to the subset of LEDs as the load power, wherein the load power directly output by the resistance of the switching element to the subset of LEDs activates the subset of LEDs such that the subset of LEDs emit light using the load power directly output by the resistance of the switching element.

2. The system according to claim 1, wherein:

the control module is further configured to generate a target power based on the portion of the supply power that is dissipated at the series module; and to generate the supply power, the power module is configured to generate the supply power based on the target power.

3. The system according to claim 1, wherein the power threshold or control signal is a maximum power threshold and wherein, to dissipate the portion of the supply power, the series module is configured to dissipate the portion of the supply power such that the load power is less than the maximum power threshold.

4. The system according to claim 3, wherein:

to modify the resistance of the series module, the series module is configured to modify, based on the indication of the maximum power threshold, the resistance of the series module such that the load power is less than the maximum power threshold.

5. The system according to claim 1, wherein the power threshold or control signal corresponds to a target power and wherein the series module is configured to dissipate the portion of the supply power such that the load power corresponds to the target power.

6. The system according to claim 5, wherein:

to modify the resistance of the series module, the series module is configured to modify, based on the indication of the target power, the resistance of the series module such the load power corresponds to the target power.

7. The system according to claim 1, wherein the series module is further configured to decouple the power module from the subset of LEDs when the load module selects the subset of LEDs from the set of LEDs.

8. The system according to claim 1, wherein, to modify the resistance of the switching element of the series module, the series module is configured to increase the resistance of the switching element to increase the portion of the supply power dissipated by the resistance of the switching element.

9. A method comprising:

generating, by a power module of a circuit, a supply power;

selecting, by a load module of the circuit, a subset of light emitting diodes (LEDs) from a set of LEDs;

receiving, by a series module of the circuit, the supply power from the power module;

dissipating, by the series module, a portion of the supply power;

outputting, by the series module, to the subset of LEDs, a remaining portion of the supply power as a load power; and driving, by a control module of the circuit, the series module to limit the amount of power at the subset of LEDs, wherein, driving the series module comprises outputting, to the series module, an indication of a power threshold or control signal, and wherein dissipating the portion of the supply power comprises modifying, based on the indication of the power threshold or control signal, a resistance of a switching element of the series module such that the resistance of the switching element dissipates the portion of the supply power and directly outputs the remaining portion of the supply power to the subset of LEDs as the load power, wherein the load power directly output by the resistance of the switching element to the subset of LEDs activates the subset of LEDs such that the subset of LEDs emit light using the load power directly output by the resistance of the switching element.

10. The method according to claim 9, further comprising:

generating, by the control module, a target power based on the portion of the supply power that is dissipated at the series module, wherein generating the supply power is based on the target power.

11. The method according to claim 9, wherein the power threshold or control signal is a maximum power threshold and wherein dissipating the portion of the supply power comprises dissipating, by the series module, the portion of the supply power such that the load power is less than the maximum power threshold.

12. The method according to claim 11, wherein:

modifying the resistance of the series module comprises modifying, by the series module, based on the indication of the maximum power threshold, the resistance of the series module such that the load power is less than the maximum power threshold.

13. The method according to claim 9, wherein the power threshold or control signal corresponds to a target power and wherein dissipating the portion of the supply power comprises dissipating, by the series module, the portion of the supply power such that the load power corresponds to the target power.

14. The method according to claim 13, wherein:

modifying the resistance of the series module comprises modifying, by the series module, based on the indication of the target power, the resistance of the series module such that the amount of power output at the subset of LEDs corresponds to the target power.

15. The method according to claim 9, further comprising:

decoupling, by the series module, the power module from the subset of LEDs when the load module selects the subset of LEDs from the set of LEDs.

16. A system comprising:

a switch logic module configured to generate a switching signal;

a set of light emitting diodes (LEDs);

a load module configured to selectively bypass, based on the switching signal, each LED of the set of LEDs to form a subset of LEDs;

a power module configured to output a supply power;

a series module configured to receive the supply power from the power, dissipate a portion of the supply power, and output, to the subset of LEDs, a remaining portion of the supply power as a load power; and a control module configured to drive the series module to limit an amount of power at the subset of LEDs, wherein, to drive the series module, the control module is configured to output, to the series module, an indication of a power threshold or control signal, and wherein, to dissipate the portion of the supply power, the series module is configured to modify, based on the indication of the power threshold or control signal, a resistance of a switching element of the series module such that the resistance of the switching element dissipates the portion of the supply power and directly outputs the remaining portion of the supply power to the subset of LEDs as the load power, wherein the load power directly output by the resistance of the switching element to the subset of LEDs activates the subset of LEDs such that the subset of LEDs emit light using the load power directly output by the resistance of the switching element.

17. The system according to claim 16, wherein:

the control module is further configured to generate a target power based on the portion of the supply power that is dissipated at the series module; and to generate the supply power, the power module is configured to generate the supply power based on the target power.

18. The system according to claim 16, wherein, to drive the series module, the control module is configured to output, to the series module, an indication of the power threshold and wherein, to dissipate the portion of the supply power, the series module is configured to:

receive an indication of the load power;

receive the indication of the power threshold; and modify the resistance of the series module further based on the indication of the load power.

19. The system according to claim 16, wherein, to drive the series module, the control module is configured to output, to the series module, an indication of the control signal and wherein:

the control module is configured to:

receive an indication of the load power;

receive the indication of the power threshold; and generate the control signal based on the indication of the load power and the power threshold; and to dissipate the portion of the supply power, the series module is configured to modify the resistance of the series module based on the control signal.

20. The system according to claim 19, wherein a logic module is configured to:

receive an indication of a selection of a mode and an indication of a reference power;

generate the power threshold based on the indication of the selection of the mode and the indication of the reference power; and output, to the control module, the indication of the power threshold.

21. The system according to claim 16, wherein the series module is further configured to decouple the power module from the subset of LEDs when the load module selectively bypasses each LED of the set of LEDs to form the subset of LEDs.

* * * * *